United States Patent [19]

Nomura

[11] 4,073,147

[45] Feb. 14, 1978

[54] WATER GATE CONTROL SYSTEM

[76] Inventor: Takeshi Nomura, 192, Yanagihara, Oyabe, Toyama, Japan

[21] Appl. No.: 721,298

[22] Filed: Sept. 8, 1976

[30] Foreign Application Priority Data

Sept. 18, 1975 Japan ..... 50-113241
May 7, 1976 Japan ..... 51-52464

[51] Int. Cl.[2] ..... E02B 7/46
[52] U.S. Cl. ..... 61/26
[58] Field of Search ..... 61/25, 22, 26, 27; 267/8

[56] References Cited

U.S. PATENT DOCUMENTS 3,507,580 4/1970 Howard et al. ..... 267/8 X

FOREIGN PATENT DOCUMENTS 1,459,403 3/1969 Germany ..... 61/25

*Primary Examiner*—Jacob Shapiro
*Attorney, Agent, or Firm*—Charles A. Blank

[57] ABSTRACT

The present invention discloses a water gate control system which selects either the automatic mode or forced mode, in the automatic mode the gate being automatically swung depending upon the level of a stream or water-way between the upright or closing position and the flat or opening position by a single- or double-acting hydraulic cylinder in which a directly or indirectly spring loaded piston is displaced depending upon the hydraulic pressure acting on the gate, and in the forced mode, the working oil under pressure being introduced into the hydraulic cylinder for swinging the gate to and holding it in a desired angular position independently of the level.

11 Claims, 7 Drawing Figures

WATER GATE CONTROL SYSTEM

BACKGROUND OF THE INVENTION

The present invention relates to generally a water gate control system and more particularly a control system for use with a water gate of the type of being swingable between a first position where the gate is held upright to close the water gate and a second position where the gate is held down backward to open the gate.

The water gates of the type described are widely used to raise the level of a stream for securing water for the irrigation or industrial purposes. In general, the gate is usually held in upright position, but when the level of a stream or water-way exceeds a predetermined level, the gate is swung to the downstream direction to permit the discharge of excess water. The water gates of the type described have been manually, electrically or hydraulically operated, but in any case an operator is required who always watches the level in the water-way to control the gate. Another problem of the conventional water gates is that the gate tends to be seriously damaged or deformed by the impacts or sudden increase in hydraulic pressure acting on the gate or drift wood striking against the gate so that smooth opening and closing of the water gate cannot be effected.

To overcome these problems there have been proposed various water gates capable of automatically opening or closing the gates depending upon the level of a stream or water-way. In one type a float is utilized, and in another type the pivot pins of the gate are loaded with helical springs so that when the impact or hydraulic pressure exerted thereto exceeds the resisting force of the springs, the gate is automatically swung to open the water gate. The former or float type however has a problem that the smooth and reliable opening and closing of the gate is frequently adversely affected by the debris surroud the float. The latter type has a problem that the corrosion of the springs tends to lead the malfunction of the gate and also another problem that the latter type cannot be applied to large-sized water gates. Furthermore both types have a common problem that the gate cannot be swung to and held in a desired angular position independently of the level in a stream or water-way so that the level cannot be changed to a desired level as needed and the maintenance and repairs of the gate are difficult and the operation of the gate is adversely affected by the deposition of sand, clay and rocks at the downstream of the water gate.

SUMMARY OF THE INVENTION

In view of the above, one of the objects of the present invention is to provide a water gate control system simple in construction and highly reliable in operation and capable of not only automatically opening or closing the gate depending upon the level in a water way but also forcibly opening or closing the gate independently of the level.

The present invention is based upon an underlying principle that in a hydraulic cylinder for controlling the swinging motion of a gate, its piston is so loaded as to resiliently resist the hydraulic pressure acting on the gate, and is characterized in that when the gate is automatically swung depending upon the level in a water-way, the working oil is permitted to freely flow into and out of the hydraulic cylinder and when the gate is forcibly swung, the hydraulic cylinder is actuated as a hydraulic actuator by forcing the working oil into or out of the hydraulic cylinder.

According to one embodiment of the present invention, a double-acting hydraulic cylinder is used for swinging the gate and its piston is directly resiliently loaded with a spring placed in the cylinder. According to another embodiment of the present invention, a single-acting hydraulic cylinder is used for swinging the gate and its piston is indirectly resiliently biased with the hydraulic pressure transmitted from a pressurized oil chamber which is provided at one end with a movable wall biased toward the other end by a spring.

The present invention provides a very ingenious combination of the spring for biasing the gate toward the upright position with a hydraulic cylinder so that the spring is not exposed to water, whereby the malfunction of the gate due to the corrosion of the spring can be completely eliminated. Furthermore the present invention provides a water gate control system which is compact in size and simple in construction yet highly reliable in operation for both automatically and forcibly opening and closing the gate.

The above and other objects, features and advantages of the present invention will become more apparent from the following description of preferred embodiments thereof taken in conjunction with the accompanying drawings.

DESCRIPTION OF THE PREFERRED EMBODIMENTS

Figure 1:
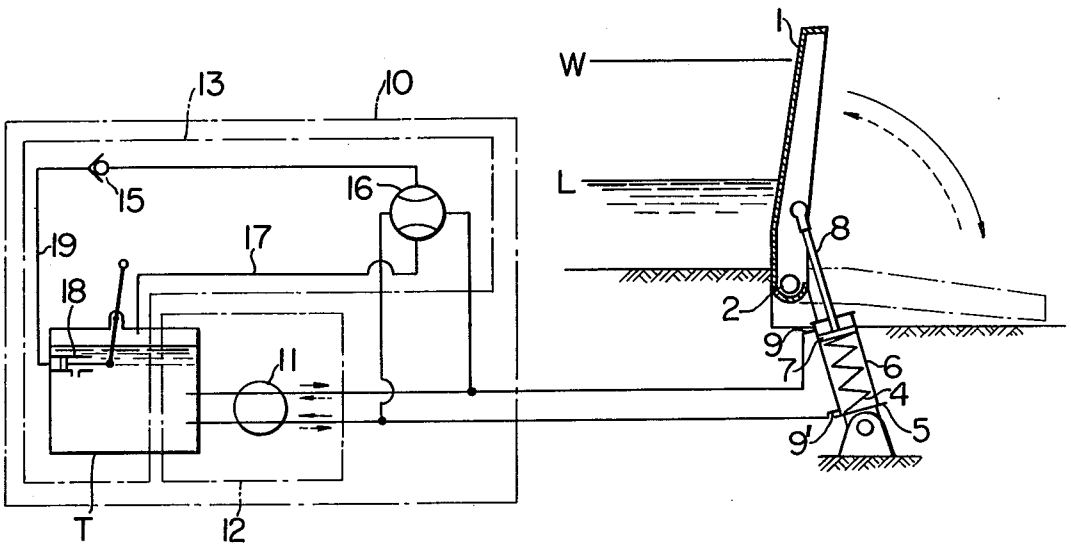
FIGS. 1 and 2 are schematic views of a first embodiment of the present invention, FIG. 1 illustrating the automatic operation mode while FIG. 2, the forced operation mode.
Figure 2:
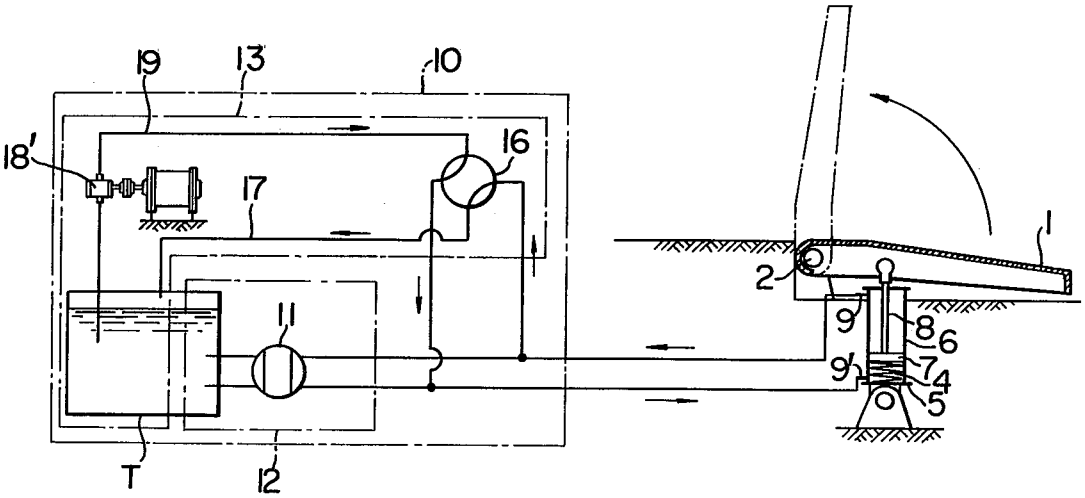

First Embodiment, FIGS. 1 and 2

In FIGS. 1 and 2 there is shown a first embodiment of a water gate control system in accordance with the present invention. A gate 1 is placed across a water-way at 90° relative to the direction of flow and is pivoted with pivot pins 2 to an understructure so that it may swing through about 90° between the upright position indicated by solid lines in FIG. 1 and the horizontal position indicated by broken lines in FIG. 1. A double-acting hydraulic cylinder 5 is arranged such that the cylinder block 6 of the hydraulic cylinder 5 is pivoted to the bed of the water-way at the downstream of the gate 1, and the free end of a piston rod 8 integral with a piston 7 is pivoted to the downstream side of the gate 1. A spring 4 which is loaded between the bottom of the cylinder block 6 and the piston 7 is capable of encountering or withstanding a predetermined hydraulic pressure exerted to the gate 1.

The hydraulic power cylinder 5 is controlled by a hydraulic control system generally indicated by the reference numeral 10 and comprising a bypass circuit 12 for permitting the free flow of the working oil into and out the hydraulic cylinder 5 when the angular position of the gate 1 is automatically controlled by the conditions for equilibrium between the hydraulic pressure acting on the gate 1 and the force of the spring 4, a forced gate position control circuit 13 for swinging the gate 1 and holding it in a desired angular position, a manual hydraulic pump 18 for pressurizing the working oil and first and second manually operated selector valves 16 and 11.

More particularly, the bypass circuit 12 hydraulically intercommunicates ports 9 and 9' of the hydraulic cylinder 5 on the one hand and a tank T through the selector valve 11, and the high pressure circuit 13 is hydraulically connected in parallel with the bypass circuit 12 in such a way that in accordance with operation of the selector valve 16 the first port 9 in communication with the chamber above the piston 7 may be selectively communicated with a drain pipe 17 communicated with the tank T while the other port 9' in communication with the chamber below the piston 7 may be communicated with the discharge pipe 19 of the pump 18 or vice versa. A check valve 15 is disposed in the discharge pipe 19 of the pump 18.

It will be understood that the present invention is not limited to the hydraulic control system described above and that any hydraulic control systems may be employed as far as they include the bypass circuit 12 for permitting the free flow of working oil into and out of the hydraulic cylinder 5 and the high pressure circuit 13 for forcing the hydraulic cylinder 5 to extend or retract its piston rod 8. Furthermore it will be understood that instead of the manually operated pump 18 shown in FIG. 1 a motor-driven pump 18' may be used as shown in FIG. 2.

Next the mode of operation of the first embodiment with the above construction will be described. When the hydraulic cylinder 5 is communicated with the bypass circuit 11 as shown in FIG. 1, both the upper and lower chambers of the hydraulic cylinder 5 are communicated through the valve 11 with the tank T so that the angular position of the gate 1 is dependent upon the equilibrium between the hydraulic pressure exerted on the gate 1 and the force of the spring 4 in the hydraulic cylinder 5. More particularly when the level of water in the water-way is at the normal level L as shown in FIG. 1, the hydraulic pressure exerting on the gate 1 is lower than the resisting force of the spring 4 in the hydraulic cylinder 5 so that the spring 4 forces the piston 7 and hence the piston rod 8 to extend upwardly and accordingly the gate 1 is held in the upright position. That is, the water gate is closed.

When the water gate is closed and the level in the water-way gradually rises and reaches the overflow level W shown in FIG. 1, the hydraulic pressure exerting on the gate 1 exceeds the resisting force of the spring 4 so that the gate 1 is swung in the direction indicated by a solid line arrow in FIG. 1, forcing the piston rod 8 into the cylinder block 6 against the spring 4. The water gate is thus opened so that the water is discharged downstream.

When the resisting force of the spring 4 overcomes the sum of the weight of the gate 1 and the hydraulic pressure acting on it, the piston rod 8 is extended to return the gate 1 to the upright position.

While the gate is automatically swung between the upright or closing position and the horizontal or opening position in the manner described above, the piston 7 is exerted with no hydraulic pressure of the working oil and is freely reciprocated in the cylinder block 6 because both the upper and lower chambers of the cylinder block 6 are communicated with the tank T through the bypass circuit 12.

Next the mode of operation for forcibly swinging the gate 1 to and holding it in a desired angular position independent of the level in the water-way will be described. Both ports 9 and 9' of the hydraulic cylinder 5 are disconnected from the bypass circuit 12 and connected to the gate position control circuit 13 by switching over the selector valves 11 and 16 as shown in FIG. 2. The port 9 in communication with the chamber above the piston 7 in the cylinder block 6 is communicated through the selector valve 16 with the drain pipe 17 while the port 9' in communication with the chamber below the piston 7 in the cylinder block 6 is communicated with the discharge pipe 19 of the pump 18 or 18'. Alternatively, the port 9 may be communicated through the selector valve 16 with the discharge pipe 19 of the pump 18 or 18' while the port 9', with the drain pipe 17. When the pump 18 or 18' is driven in the latter case, the working oil under pressure is forced into the upper chamber in the piston block 6 while the working oil in the lower chamber is returned through the drain pipe 17 to the tank T. Therefore the working oil under pressure forces the piston 7 downward against the spring 4 so that the gate 1 is swung in the downstream direction.

To raise the gate 1 independently of the water level in the water-way, the selective valve 16 is switched over to communicate the port 9 with the drain pipe 17 and to communicate the port 9' with the discharge pipe 19 of the pump 18 or 18' as shown in FIG. 2 so that the working oil under pressure is forced into the lower chamber in the cylinder block 6 to extend the piston rod 8 and consequently the gate 1 is raised.

When the gate 1 is raised or lowered to a desired angular position, the first selector valve 16 may be closed as shown in FIG. 1 while the second selector valve 11 is kept closed so that the gate 1 may be held in the upright or any desired angular position regardless of the level of water in the water-way.

Since the hydraulic cylinder 5 is loaded with the spring 4, the abrupt swing of the gate 1 to the horizontal position may be prevented, and a relatively low pressure is required to swing the gate 1 to the upright position so that the hydraulic equipment small in size and light in weight may be advantageously used.

Figure 4:
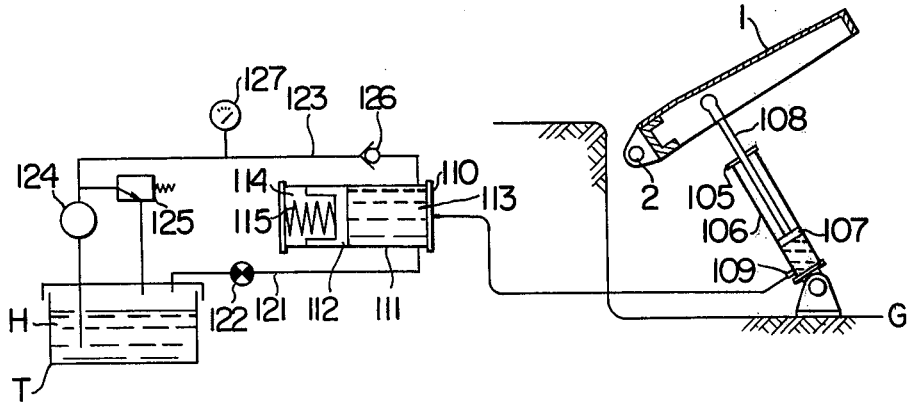
Figure 5:
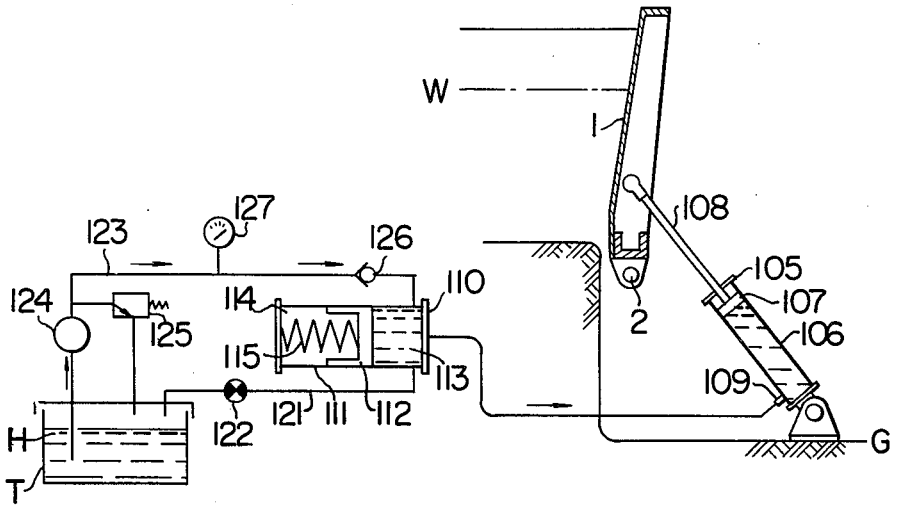
Figure 6:
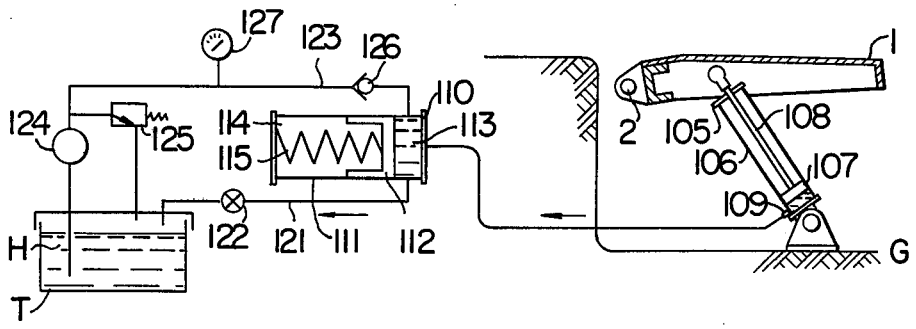

Second Embodiment, FIGS. 4, 5 and 6

In the second embodiment shown in FIGS. 4 through 6, the gate 1 is operatively coupled to a single-acting hydraulic cylinder 105 having a cylinder block 106 pivoted to the bed G of the water-way at the downstream of the gate 1 and a piston 107 formed integral with a piston rod 108 the free end of which is pivoted to the gate 1. A port 109 of the hydraulic cylinder 105 is communicated with a hydraulic control device generally indicated by the reference numeral 110. The hydraulic control device 110 comprises a cylinder block 111, a piston 112 slidable with said cylinder and defining therein a pressurized oil chamber 113 communicated with said port 109 and a buffer chamber 114 disposing therein a spring 115 for biasing the piston 112 toward the oil chamber 113. The buffer chamber 114 has a volume larger than the cylinder 105 and a vent to the atmosphere not shown.

The pressurized oil chamber 113 is communicated with the oil tank T through a bypass line 121 including a valve 122 and through a high pressure line 123 including a pump 124 with a relief valve 125, a check valve 126 and a pressure gage 127.

Figure 7:
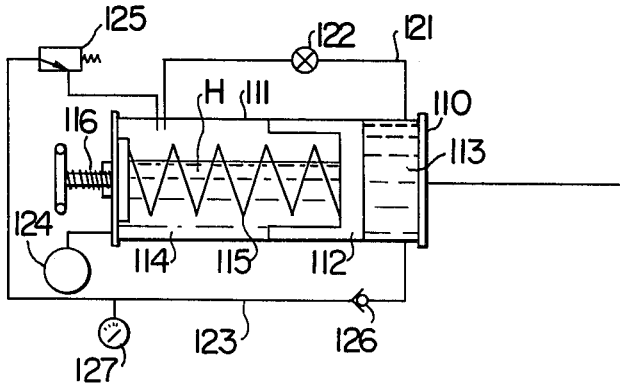
FIG. 7 is a schematic view, on enlarged scale, illustrating a modification of the second embodiment.

As shown in FIG. 7, an adjusting screw 116 may be provided in order to adjust the force of the spring 115 acting on the piston so that the level W in the water-way at which the gate 1 is swung to the horizontal or opening position may be suitably selected.

Figure 3:
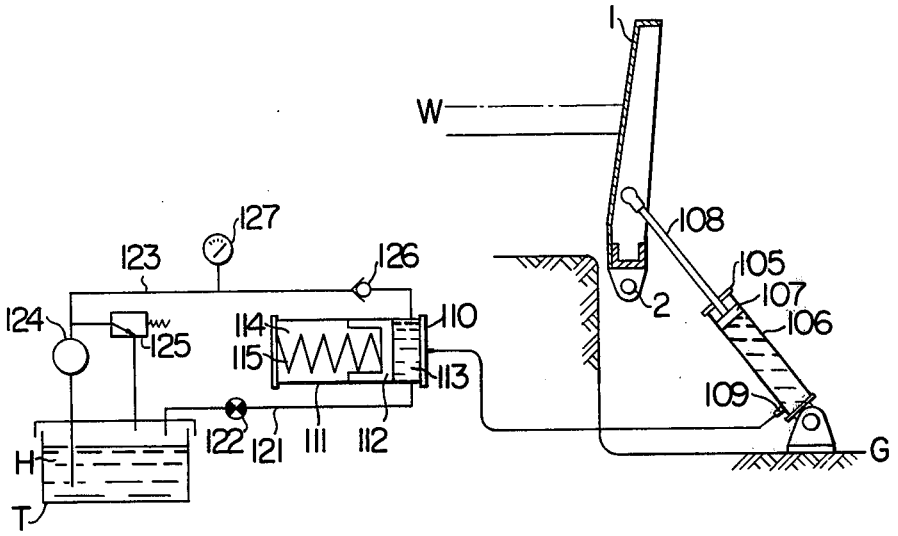
FIGS. 3 through 6 are schematic views of a second embodiment of the present invention, FIG. 3 illustrating the gate in the upright position in the automatic mode, FIG. 4 illustrating the gate in an inclined position in the automatic mode, FIG. 5 illustrating the gate in the upright position in the forced mode, and FIG. 6 illustrating the gate in the laid position in the forced mode.

Next the mode of operation of the second embodiment will be described. First the force of the spring 115 is adjusted so that the gate 1 may be swung from the upright or closing position to the horizontal or opening position at a desired level W in the water-way. When the valve 122 in the bypass line 121 is closed, the gate 1 is held in the upright position as long as the resisting force of the spring 115 in the hydraulic control device 110 exceeds the hydraulic pressure exerted to the gate 1 as shown in FIG. 3. However, when the level rises so that the hydraulic pressure acting on the gate 1 exceeds the force of the spring 115, the working oil in the hydraulic cylinder 115 is forced to be discharged into the oil chamber 113 of the hydraulic control device 110, displacing the piston 112 toward the left against the spring 115 until the equilibrium is established between the force of the spring 115 and the hydraulic pressure of the working oil in the oil chamber 113. Consequently the gate 1 is swung into the inclined position as shown in FIG. 4, and the level of water in the water-way is lowered so that the hydraulic pressure acting on the gate 1 is gradually decreased. When the force of the spring 115 exceeds the hydraulic pressure acting on the gate 1, the spring 115 forces the piston 112 toward the right so that the working oil in the oil chamber 113 is forced to flow into the hydraulic cylinder 105, extending the piston rod 108 and consequently the gate 1 is returned to the upright position. Thus the gate 1 is automatically swung between the upright position and the inclined position depending upon the level in the water-way; that is, the balance between the force of the spring 115 in the hydraulic control device 110 and the hydraulic pressure acting on the gate 1. During the automatic gate control operation in this mode, no hydraulic liquid H flows out from the pressurized oil chamber 113 of the hydraulic control device 110 through the bypass line 121 and the high pressure line 123. In other words, the working oil H in the hydraulic cylinder 105 and the working oil chamber 113 of the hydraulic control device 110 is sealed and transmits the hydraulic pressure acting on the gate 1 to the piston 112 and hence the spring 115 or vice versa.

To swing the gate 1 to the horizontal position independently of the level in the water-way, the valve 122 in the bypass line 121 is opened as shown in FIG. 6 so that the working oil H in the hydraulic cylinder 105 and the oil chamber 113 of the hydraulic control device 110 is returned to the tank T and consequently the gate 1 is swung downward by its own weight. On the other hand, when it is desired to return the gate 1 to the upright position irrespective of the water level, the valve 122 in the bypass line 121 is closed and then the pump 124 is energized so that the working oil under pressure is introduced into the oil chamber 113 through the high pressure line 123 as shown in FIG. 5. The working oil H under pressure forces the piston 112 toward the buffer chamber 114 against the spring 115 and at the same time flows into the hydraluc cylinder 105 to extend the rod 108, whereby the gate 1 is swung back to the upright position.

As described above, in the second embodiment the hydraulic pressure acting on the piston 107 of the hydraulic cylinder 105 can be adjusted by the adjustment of the force of the spring 115 acting on the piston 112 of the hydraulic control device 110 which is installed independently of the hydraulic cylinder 105 so that, as compared with the first embodiment, the second embodiment has an advantage in that the adjustment and replacement of the spring 115 may be much facilitated.

The second embodiment may be further so modified as shown in FIG. 7, that the buffer chamber 114 in the hydraulic control device 110 may be used as a working oil storage chamber. The buffer or storage chamber 114 may be communicated with the pressurized oil chamber 113 through the bypass circuit 112 and the high pressure circuit 123 in a manner substantially similar to that of the second embodiment. The mode of operation of the modification is substantially similar to that of the second embodiment.

As described above, according to the present invention the gate 1 is swung between the upright or closing position and the inclined or opening position by the hydraulic cylinder actuable by both the force of the spring and the hydraulic pressure produced by the pump. That is, the force of the spring is directly or indirectly acting as the back pressure on the piston of the hydraulic cylinder when the working oil under pressure is not forced into the hydraulic cylinder. Therefore the gate is automatically opened or closed depending upon the difference between the hydraulic pressure acting on the gate and hence on the piston through the piston rod and the back pressure by the spring. Thus even in case of a sudden increase in level in a water-way due to a heavy rainfall within a short time, the gate is automatically opened to prevent a flood. Even when the debris such as logs strike against the gate, the impacts can be satisfactorily absorbed because the gate is substantially elastically supported by the spring so that the damages to the gate may be eliminated. Furthermore no operator is required for controlling the water level so that the maintenance cost may be considerably reduced. Moreover the gate may be swung to any desired angular position independently of the level in the water-way when the hydraulic cylinder is communicated with the high pressure circuit of the hydraulic control system so that the maintenance and repair of the gate may be much facilitated.

The spring used in the present invention may be a helical spring or disk spring and prevented from corrosion because the spring is sealed from water. Furthermore even when the spring is damaged, its function will not be lost even though the effective length of the spring may be reduced slightly.

Thus the water gate control system of the present invention which permits both the automatic swinging of the gate depending upon the level in the water-way and the forced swinging of the gate irrespective of the water level is very advantageous in that the operation and maintenance of the water gate may be much simplified and the damages to the gate may be completely eliminated in case of a flood.

What is claimed is:

1. A water gate control system comprising a gate installed across a water-way for swinging motion between a first position where said gate is held upright to prevent the flow of water in said water-way and a second position where said gate is held down toward the downstream side to permit the flow of water through the gate, a hydraulic cylinder comprising a cylinder block, a piston slidably fitted into said cylinder block and a piston rod formed integral with or joined to said piston, the free end of said piston rod being pivoted to said gate, said hydraulic cylinder comprising a double-acting hydraulic cylinder wherein a spring is loaded in either of two chambers defined by said piston in said cylinder block for biasing said piston in the direction in which said gate is swung to and held in said first position, first gate control means for resiliently loading said piston in said hydraulic cylinder in such a way that said gate is held in said first position when the level of water in said water-way on the upstream side of said gate is lower than a predetermined level and said gate is automatically fallen down toward said second position when the level exceeds said predetermined level, second control means including a high pressure hydraulic control circuit for selective hydraulic communication with said hydraulic cylinder for actuating the same, thereby swinging said gate to and holding it at any desired angular position between said first and second positions irrespective of the level in said water-way, change-over means for bringing said hydraulic cylinder under control with either of said first or second gate control means, a working oil storage chamber, a pump for pumping the working oil from said working oil storage chamber and pressurizing the working oil, a high pressure line with one end communicated with the discharge port of said pump, a drain line with one end communicated with said working oil storage chamber, first and second hydraulic lines with one ends communicated with first and second ports, respectively, of said double-acting hydraulic cylinder, a first selector valve for selectively communicating the other end of said first hydraulic line with the other end of either of said high pressure line or said drain line while communicating the other end of said second hydraulic line with the other end of either said drain line or said high pressure line, and first and second bypass lines communicating said first and second ports of said double-acting hydraulic cylinder with said working oil storage chamber, and a second selector valve for opening or closing said first and second bypass lines.

2. A water gate control system comprising a gate installed across a water-way for swinging motion between a first position where said gate is held upright to prevent the flow of water in said water-way and a second position where said gate is held down toward the downstream side to permit the flow of water through the gate, a hydraulic cylinder comprising a cylinder block, a piston slidably fitted into said cylinder block and a piston rod formed integral with or joined to said piston, the free end of said piston rod being pivoted to said gate, said hydraulic cylinder being a single-acting hydraulic cylinder with a port communicated with a pressurized oil chamber which is provided at its one end with a movable wall biased toward its other end by a spring, first gate control means for resiliently loading said piston in said hydraulic cylinder in such a way that said gate is held in said first position when the level of water in said water-way on the upstream side of said gate is lower than a predetermined level and said gate is automatically fallen down toward said second position when the level exceeds said predetermined level, second control means including a high pressure hydraulic control circuit for selective hydraulic communication with said hydraulic cylinder for actuating the same, thereby swinging said gate to and holding it at any desired angular position between said first and second positions irrespective of the level in said water-way, and change-over means for bringing said hydraulic cylinder under control with either of said first or second gate control means.

3. A water gate control system as set forth in claim 2, comprising a working oil storage chamber, a pump for pumping up the working oil from said working oil storage chamber and pressurizing the working oil, a high pressure line with one end communicated with the discharge port of said pump and the other end communicated with said pressurized oil chamber, a check valve provided in said high pressure line for preventing the flow of the working oil from said pressurized oil chamber to said pump, a drain line for intercommunicating said pressurized oil chamber and said working oil storage chamber, and a valve provided in said drain line for opening or closing the hydraulic communication between said pressurized oil chamber and said working oil storage chamber.

4. A water gate control system as set forth in claim 3, comprising a second cylinder block, a piston slidable in said second cylinder block and defining therein two chambers one of which forms said pressurized oil chamber and the other of which forms a buffer chamber in which a spring is loaded for biasing said piston toward said pressurized oil chamber.

5. A water gate control system as set forth in claim 4, wherein an adjusting screw is screwed through the end wall of said buffer chamber for adjusting the force of said spring acting on said piston.

6. A water gate control system as set forth in claim 4, wherein said buffer chamber is used as said working oil storage chamber.

7. A water gate control system comprising a gate installed across a water-way for swinging motion between a first position where said gate is held upright to prevent the flow of water in said water-way and a second position where said gate is held down toward the downstream side to permit the flow of water through the gate, and a spring for urging said gate toward said first position, said control system further comprising a hydraulic cylinder disposed in the vicinity of said gate and comprising a cylinder block, a piston slidably fitted into said cylinder block and a piston rod integral with said piston, the free end of said piston rod being pivoted to said gate, and said spring being arranged to urge said piston so as to hold said gate at said first position when the level of water in said water-way on the upstream side of said gate is lower than a predetermined level.

8. A water gate control system as set forth in claim 7 wherein said hydraulic cylinder consists of a double-acting hydraulic cylinder, two chambers being defined by said piston in said cylinder block and being in oil communication with an oil reservoir and said spring being disposed in one of said chambers on the side opposite to said piston rod for directly urging said piston.

9. A water gate control system as set forth in claim 8, further comprising a pump for pumping oil from said reservoir and discharging pressurized working oil and selector valve means for selectively communicating one of said chambers of said cylinder with either the discharge port of said pump or said reservoir while communicating the other chamber with either said reservoir or the discharge port of said pump.

10. A water gate control system as set forth in claim 7 wherein said hydraulic cylinder comprises a single-acting hydraulic cylinder, the working chamber of said cylinder being communicated with an enclosed oil chamber spaced apart from said cylinder and said oil chamber being contractible by the action of said spring so that the oil within said oil chamber is pressurized to urge said piston.

11. A water gate control system as set forth in claim 10, further comprising an oil reservoir communicating with said oil chamber, a valve for opening or closing the oil communication between said oil chamber and said oil reservoir, a pump for pumping oil from said oil reservoir and feeding the pressurized oil to said oil chamber, and a check valve for preventing the reverse flow of oil from said oil chamber to said pump.

* * * * *